US011073164B2

(12) United States Patent
Iwakiri

(10) Patent No.: US 11,073,164 B2
(45) Date of Patent: Jul. 27, 2021

(54) CENTRIFUGAL COMPRESSOR AND TURBOCHARGER INCLUDING THE SAME

(71) Applicant: MITSUBISHI HEAVY INDUSTRIES ENGINE & TURBOCHARGER, LTD., Sagamihara (JP)

(72) Inventor: Kenichiro Iwakiri, Tokyo (JP)

(73) Assignee: MITSUBISHI HEAVY INDUSTRIES ENGINE & TURBOCHARGER, LTD., Sagamihara (JP)

( * ) Notice: Subject to any disclaimer, the term of this patent is extended or adjusted under 35 U.S.C. 154(b) by 106 days.

(21) Appl. No.: 16/605,454

(22) PCT Filed: Nov. 6, 2017

(86) PCT No.: PCT/JP2017/039909
§ 371 (c)(1),
(2) Date: Oct. 15, 2019

(87) PCT Pub. No.: WO2019/087385
PCT Pub. Date: May 9, 2019

(65) Prior Publication Data

US 2021/0123456 A1 Apr. 29, 2021

(51) Int. Cl.
*F04D 29/44* (2006.01)
*F04D 29/42* (2006.01)
*F02B 39/00* (2006.01)

(52) U.S. Cl.
CPC ..... *F04D 29/441* (2013.01); *F02B 39/00* (2013.01); *F04D 29/4206* (2013.01);
(Continued)

(58) Field of Classification Search
CPC .. F04D 29/4206; F04D 29/422; F04D 29/441; F05D 2220/40; F05D 2240/12; F05D 2240/14
See application file for complete search history.

(56) References Cited

U.S. PATENT DOCUMENTS 9,366,265 B2 * 6/2016 Tomita ..... F04D 29/4226
9,562,541 B2 * 2/2017 Iwakiri ..... F04D 29/667
(Continued)

FOREIGN PATENT DOCUMENTS

CN 103052808 A 4/2013
CN 103415707 A 11/2013
(Continued)

OTHER PUBLICATIONS

Office Action dated Jul. 31, 2020 issued in counterpart Chinese Application No. 201780090061.3 with machine translation.
(Continued)

*Primary Examiner* — Ninh H. Nguyen
(74) *Attorney, Agent, or Firm* — Birch, Stewart, Kolasch & Birch, LLP

(57) ABSTRACT

An inclination angle between a direction perpendicular to a rotational axis and a tangential direction of a radially outer edge of a radially outermost concave arc portion, which is located outermost in the radial direction of an impeller among at least one concave arc portion, has a distribution along the circumferential direction of a scroll passage, and when a circumferential position in the scroll passage from a tongue of a scroll part to an outlet of the scroll passage is represented by a central angle about the rotational axis by using the tongue as a reference, the distribution of the inclination angle has a local minimum value or a minimum value in a range of the central angle of 30° to 210°.

5 Claims, 9 Drawing Sheets

(52) U.S. Cl.
CPC ..... *F05D 2220/40* (2013.01); *F05D 2240/12* (2013.01); *F05D 2240/14* (2013.01)

(56) References Cited

U.S. PATENT DOCUMENTS

| | | | | |
|---|---|---|---|---|
| 2010/0178163 | A1 | 7/2010 | Dettmann et al. | |
| 2013/0266432 | A1* | 10/2013 | Iwakiri | F04D 29/441 415/204 |
| 2013/0272865 | A1 | 10/2013 | Hoshi et al. | |
| 2013/0343885 | A1 | 12/2013 | Iwakiri et al. | |
| 2016/0003259 | A1 | 1/2016 | Yonezawa et al. | |
| 2018/0347382 | A1 | 12/2018 | Iwakiri et al. | |
| 2018/0355886 | A1* | 12/2018 | Fujiwara | F04D 29/4206 |

FOREIGN PATENT DOCUMENTS

| | | | |
|---|---|---|---|
| JP | 2010-529358 | A | 8/2010 |
| JP | 2010-216378 | A | 9/2010 |
| JP | 2012-193716 | A | 10/2012 |
| JP | 2016-17419 | A | 2/2016 |
| WO | WO 2012/090853 | A1 | 7/2012 |
| WO | WO 2017/109949 | A1 | 6/2017 |

OTHER PUBLICATIONS

International Preliminary Report on Patnetability and Written Opinion of the International Searching Authority, dated May 22, 2020, for International Application No. PCT/JP2017/039909, with an English Translation.

International Search Report, dated Jan. 23, 2018, for International Application No. PCT/JP2017/039909, with an English translation.

* cited by examiner

CENTRIFUGAL COMPRESSOR AND TURBOCHARGER INCLUDING THE SAME

TECHNICAL FIELD

The present disclosure relates to a centrifugal compressor and a turbocharger including the centrifugal compressor.

BACKGROUND ART

In recent year, it is desired to enlarge the operating region of centrifugal compressors. For instance, as automobile engines require to improve fuel efficiency and acceleration performance in a low speed region, turbochargers require to improve the efficiency in a low speed and low flow rate operating point. Such an operating region is a region where a centrifugal compressor of a turbocharger operates in a stall condition. In this region, large separation is observed in a scroll passage. Patent Document 1 describes that separation occurs due to recirculation flow from the scroll end to the scroll start in the scroll passage.

CITATION LIST

Patent Literature

Patent Document 1: WO2017/109949A

SUMMARY

Problems to be Solved

However, as a result of intensive studies by the present inventors, they have found that separation occurs by a factor other than the recirculation flow described in Patent Document 1. More specifically, compressed air discharged from a diffuser passage in the vicinity of a tongue of a scroll part forming the scroll passage swirls and flows through the scroll passage along the inner wall surface of the scroll passage. Such a swirl flow having made one round along the inner wall surface of the scroll passage interferes with compressed air discharged from the diffuser passage. This is one of factors of separation in the scroll passage.

In view of the above, an object of at least one embodiment of the present disclosure is to provide a centrifugal compressor and a turbocharger including the centrifugal compressor whereby it is possible to improve the efficiency in a low flow rate operating point.

Solution to the Problems (1) A centrifugal compressor according to at least one embodiment of the present disclosure comprises: an impeller and a housing. The housing includes: a scroll part having a scroll passage of a spiral shape formed on an outer peripheral side of the impeller; and a diffuser part including a pair of passage walls spaced from each other in an extension direction of a rotational axis of the impeller and forming a diffuser passage, communicating with the scroll passage along a circumferential direction of the scroll passage on a radially inner side of the impeller, between the pair of passage walls. The pair of passage walls includes: a first passage wall; and a second passage wall positioned closer to a scroll center of the scroll passage than the first passage wall is to the scroll center in the extension direction of the rotational axis. The second passage wall includes a radially inner portion of an inner wall surface of the scroll passage, and the radially inner portion of the inner wall surface included in the second passage wall forms at least one concave arc portion having a curvature radius inside the scroll passage in a cross-section of the housing formed by a plane that includes the rotational axis. The at least one concave arc portion includes a radially outermost concave arc portion located outermost in a radial direction of the impeller, and an inclination angle between a tangential direction of a radially outer edge of the radially outermost concave arc portion and a direction perpendicular to the rotational axis has a distribution along the circumferential direction of the scroll passage. When a circumferential position in the scroll passage from a tongue of the scroll part to an outlet of the scroll passage is represented by a central angle about the rotational axis by using the tongue as a reference, the distribution of the inclination angle has a local minimum value or a minimum value in a range of the central angle of 30° to 210°.

With the above configuration (1), as a swirl flow swirling and flowing through the scroll passage along the inner wall surface of the scroll passage circulates one round along the inner wall surface of the scroll passage, the angle between the direction of the swirl flow and the flow direction of a compressed fluid discharged from the diffuser passage decreases. Thus, interference between the swirl flow and the flow of the compressed fluid discharged from the diffuser passage is reduced, and the occurrence of separation in the scroll passage is reduced. As a result, it is possible to improve the efficiency of the centrifugal compressor in a low flow rate operating point.

(2) In some embodiments, in the above configuration (1), the distribution of the inclination angle has the local minimum value or the minimum value in a range of the central angle of 30° to 120°.

The flow passage area of the scroll passage gradually decreases from the outlet toward the tongue. Due to this shape of the scroll passage, the inclination angle of the concave arc portion tends to increase as it approximates to the tongue. With the above configuration (2), by forming the scroll passage such that the inclination angle has a local minimum value or a minimum value in the range of the central angle of 30° to 120° where the inclination angle tends to increase if the scroll passage is formed without considering the size of the inclination angle, it is possible to decrease the inclination angle in the range of the central angle of 30° to 210°. Thus, interference between the swirl flow and the flow of the compressed fluid discharged from the diffuser passage is reduced, and the occurrence of separation in the scroll passage is reduced. As a result, it is possible to improve the efficiency of the centrifugal compressor in a low flow rate operating point.

(3) In some embodiments, in the above configuration (1) or (2), the second passage wall includes: a flat inner wall surface which defines the diffuser passage and is flat and perpendicular to the rotational axis; a convex inner wall surface defining the scroll passage and curved convexly with respect to the scroll passage; at least one concave inner wall surface defining the scroll passage and forming the at least one concave arc portion in the cross-section of the housing formed by the plane that includes the rotational axis, the at least one concave inner wall surface including a radially outermost concave inner wall surface located outermost in the radial direction of the impeller and connected to the convex arc portion; and an end surface connecting the flat inner surface and the convex inner wall surface at an outermost portion of the flat inner surface in the radial direction of the impeller.

With the above configuration (3), in addition to that it is possible to reduce interference between the swirl flow and the flow of the compressed fluid discharged from the diffuser passage and reduce the occurrence of separation in the scroll passage, since the inner wall defining the diffuser passage is flat and perpendicular to the rotational axis, it is possible to easily perform processing of the diffuser passage.

(4) In some embodiments, in any one of the above configurations (1) to (3), an outer diameter of the diffuser passage about the rotational axis has a distribution in a circumferential direction of the diffuser passage, and the distribution of the outer diameter of the diffuser passage has a local maximum value or a maximum value in a range of the central angle of 30° to 210°.

With the above configuration (4), since the inclination angle of the concave arc portion has a local minimum value or a minimum value in the range of the central angle of 30° to 210°, interference between the swirl flow and the flow of the compressed fluid discharged from the diffuser passage is reduced, and the occurrence of separation in the scroll passage is reduced. As a result, it is possible to improve the efficiency of the centrifugal compressor in a low flow rate operating point.

(5) In some embodiments, in any one of the above configurations (1) to (4), a distance from the rotational axis to the scroll center of the scroll passage has a distribution in a circumferential direction of the diffuser passage, and the distribution of the distance has a local minimum value or a minimum value in a range of the central angle of 30° to 210°.

With the above configuration (5), since the inclination angle of the concave arc portion has a local minimum value or a minimum value in the range of the central angle of 30° to 210°, interference between the swirl flow and the flow of the compressed fluid discharged from the diffuser passage is reduced, and the occurrence of separation in the scroll passage is reduced. As a result, it is possible to improve the efficiency of the centrifugal compressor in a low flow rate operating point.

(6) A turbocharger according to at least one embodiment of the present disclosure comprises: the centrifugal compressor described in any one of the above (1) to (5).

With the above configuration (6), since the occurrence of separation in the scroll passage is reduced, it is possible to improve the efficiency of the turbocharger in a low speed and low flow rate operating point.

Advantageous Effects

According to at least one embodiment of the present disclosure, as a swirl flow swirling and flowing through the scroll passage along the inner wall surface of the scroll passage circulates one round along the inner wall surface of the scroll passage, the angle between the direction of the swirl flow and the flow direction of a compressed fluid discharged from the diffuser passage decreases. Thus, interference between the swirl flow and the flow of the compressed fluid discharged from the diffuser passage is reduced, and the occurrence of separation in the scroll passage is reduced. As a result, it is possible to improve the efficiency of the centrifugal compressor in a low flow rate operating point.

DETAILED DESCRIPTION

Embodiments of the present invention will now be described in detail with reference to the accompanying drawings. However, the scope of the present invention is not limited to the following embodiments. It is intended that dimensions, materials, shapes, relative positions and the like of components described in the embodiments shall be interpreted as illustrative only and not intended to limit the scope of the present invention.

A centrifugal compressor according to an embodiment of the present disclosure will be described by taking a centrifugal compressor of a turbocharger as an example. However, the centrifugal compressor in the present disclosure is not limited to a centrifugal compressor of a turbocharger, and may be any centrifugal compressor which operates alone. Although a fluid to be compressed by the compressor is air in the following description, the fluid may be replaced by any other fluid.

Figure 1:
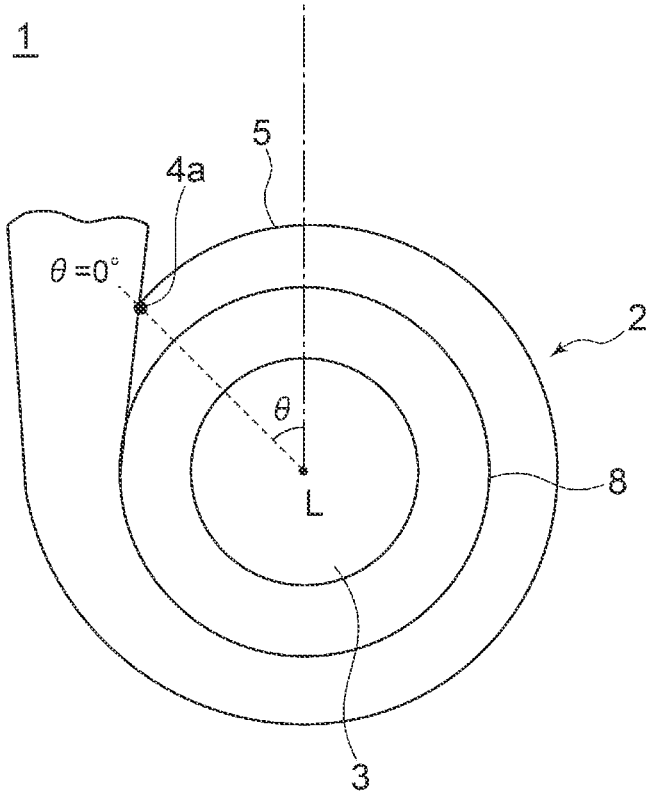
FIG. 1 is a schematic diagram of an exemplary cross-section perpendicular to the rotational axis of a centrifugal compressor according to an embodiment of the present disclosure.
Figure 2:
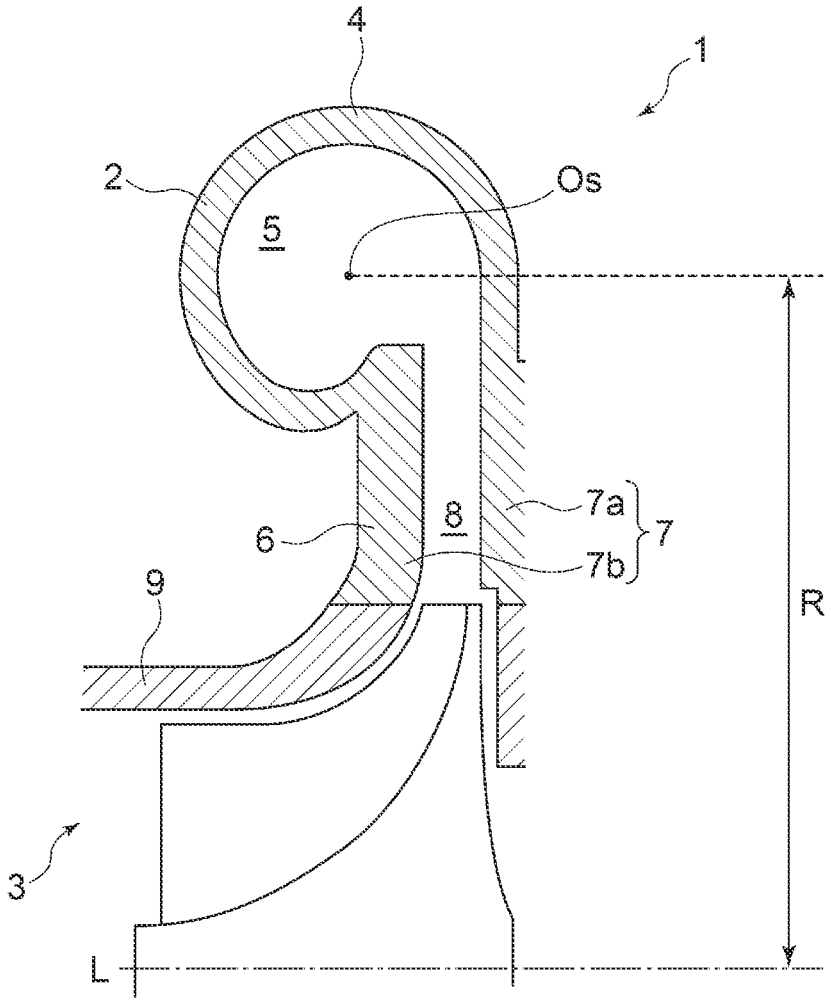
FIG. 2 is a partial cross-sectional view of a housing of a centrifugal compressor in a plan view including the rotational axis of the centrifugal compressor according to an embodiment of the present disclosure.

As shown in FIG. 1, the centrifugal compressor 1 includes a housing 2 and an impeller 3 rotatably disposed around the rotational axis L within the housing 2. As shown in FIG. 2, the housing 2 includes a scroll part 4 having a scroll passage 5 of spiral shape formed on the outer peripheral side of the impeller 3, a diffuser part 6 having a pair of passage walls 7, i.e., a first passage wall 7*a* and a second passage wall 7*b*, spaced from each other in an extension direction of the rotational axis L, and an air inlet part 9 of cylindrical shape. The second passage wall 7*b* is positioned closer to the scroll center $O_s$ of the scroll passage 5 than the first passage wall 7*a* is in the extension direction of the rotational axis L. Between the first passage wall 7*a* and the second passage wall 7*b*, a diffuser passage 8 is formed and communicates with the scroll passage 5 along the circumferential direction of the scroll passage 5 on the radially inner side of the impeller 3.

Air flowing into the centrifugal compressor 1 through the air inlet part 9 is compressed by the impeller 3 into compressed air. The compressed air flows through the diffuser passage 8 into the scroll passage 5 and then passes through the scroll passage 5 and is discharged from the centrifugal compressor 1.

When the flow rate of air into the centrifugal compressor 1 is small since, for instance, the turbocharger operates at low speed, the centrifugal compressor 1 operates in a stall condition, resulting in a decrease in efficiency. In such an operating region, large separation is observed in the scroll passage 5. The present inventors have found one of factors that cause this separation as a result of intensive studies. The mechanism of separation due to this factor will now be described.

As shown in FIG. 1, the circumferential position in the scroll passage 5 from a tongue 4*a* of the scroll part 4 (see FIG. 2) to the outlet of the scroll passage 5 is represented by a central angle θ about the rotational axis L by using the tongue 4*a* as a reference. Accordingly, the central angle θ representing the circumferential position of the tongue 4*a* is 0°.

Figure 3:
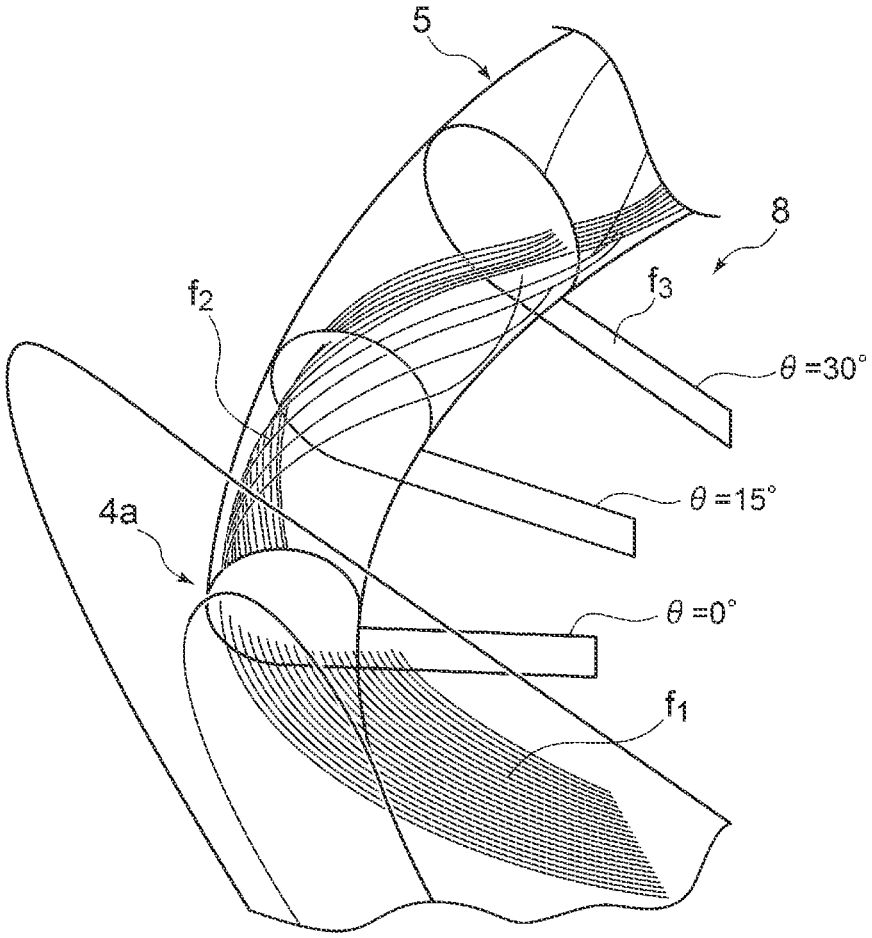
FIG. 3 is a streamline diagram showing compressed air discharged from a diffuser passage and swirling along an inner wall surface of a scroll passage in a centrifugal compressor according to an embodiment of the present disclosure.

As shown in FIG. 3, the flow $f_1$ of compressed air discharged from the diffuser passage 8 in the vicinity of the tongue 4*a* swirls and flows through the scroll passage 5 along the inner wall surface of the scroll passage 5. When this swirl flow $f_2$ of the compressed air circulates one round along the inner wall surface of the scroll passage 5 (in FIG. 3, at a position where the central angle θ is 30° approximately), the swirl flow $f_2$ interferes with compressed air $f_3$ discharged from the diffuser passage 8. This interference is one of factors of separation in the scroll passage 5.

Figure 4A:
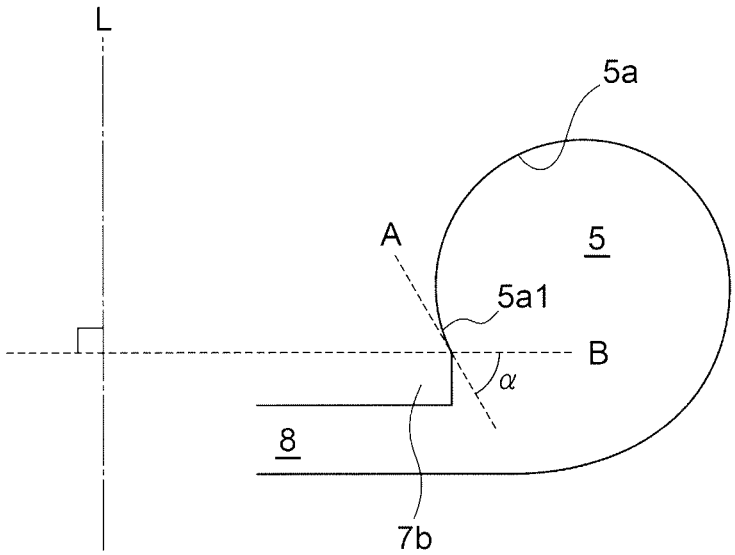
FIG. 4 is a schematic diagram for describing the principle of interference between swirl flow and compressed air discharged from a diffuser passage in a scroll passage.
Figure 4B:
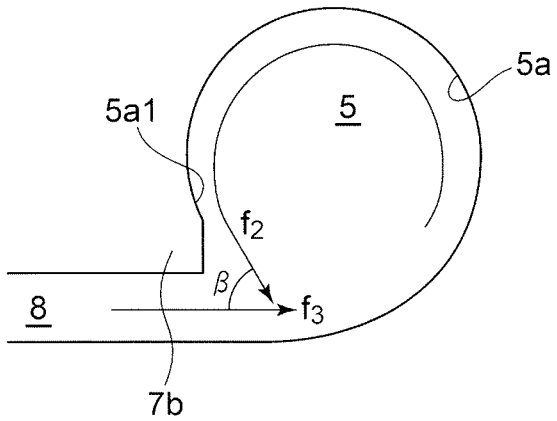

As shown in FIG. 4A, in a cross-section of the housing 2 (see FIG. 2) including the rotational axis L, as an inclination angle α between a tangential direction A of a portion 5*a*1 of the inner wall surface 5*a* of the scroll passage 5 connected to the second passage wall 7*b* and a direction B perpendicular to the rotational axis L increases, i.e., as the inclination angle α approximates to 90°, the angle β between the swirl flow $f_2$ of the compressed air flowing along the inner wall surface 5*a* of the scroll passage 5 and the flow $f_3$ of the compressed air discharged from the diffuser passage 8 increases. Thus, the swirl flow $f_2$ interferes with and blocks the flow $f_3$ of the compressed air that is about to flow from the diffuser passage 8 into the scroll passage 5, so that separation is caused at the interference portion.

Figure 5:
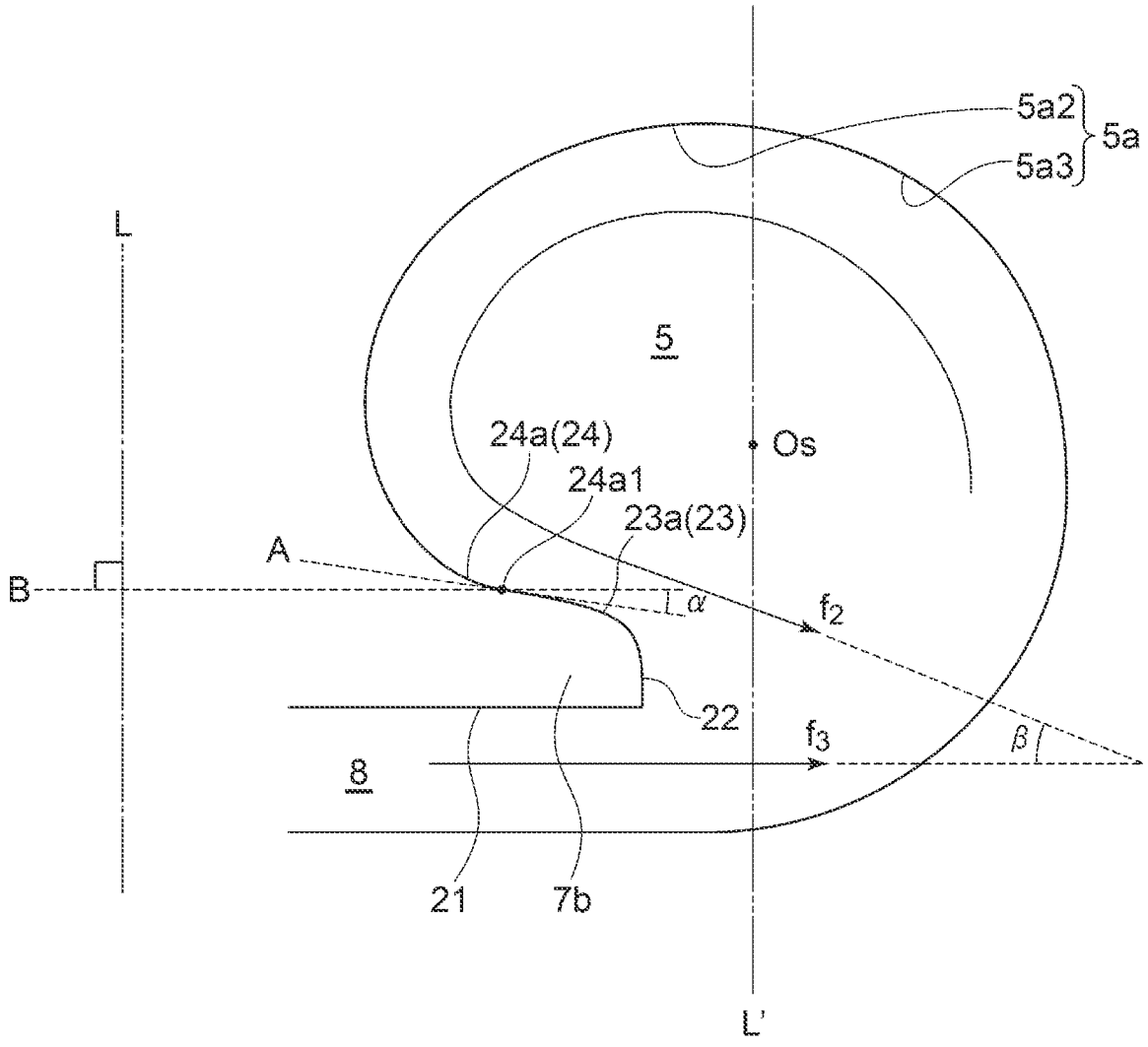
FIG. 5 is a schematic cross-sectional view showing the cross-sectional shape of a scroll passage of a centrifugal compressor according to an embodiment of the present disclosure.

Therefore, to suppress the occurrence of interference, the cross-sectional shape of the scroll passage 5 needs to have a reduced inclination angle α. FIG. 5 shows an exemplary cross-sectional shape of the scroll passage 5 with a reduced inclination angle α. The second passage wall 7*b* includes a flat inner wall surface 21 which defines the diffuser passage 8 and is flat and perpendicular to the rotational axis L, a flat end surface 22 connected to the radially outermost portion of the flat inner wall surface 21 at right angle, a convex inner wall surface 23 connected to the end surface 22 and curved convexly with respect to the scroll passage 5, and a concave inner wall surface 24 connected to the convex inner wall surface 23 and curved concavely with respect to the scroll passage 5. Here, the inner wall surface 5*a* of the scroll passage 5 is divided into a radially inner portion 5*a*2 and a radially outer portion 5*a*3 by a virtual line L' passing through the scroll center $O_s$ and parallel to the rotational axis L. The end surface 22, the convex inner wall surface 23, and the concave inner wall surface 24 are a part of the portion 5*a*2 of the inner wall surface 5*a*.

Curving convexly with respect to the scroll passage 5 means that the curvature center of a convex arc portion 23*a* forming the convex inner wall surface 23 is positioned outside the scroll passage 5 in the cross-section of the housing 2 (see FIG. 2) including the rotational axis L, and curving concavely with respect to the scroll passage 5 means that the curvature center of a concave arc portion 24*a* forming the concave inner wall surface 24 is positioned inside the scroll passage 5 in the cross-section of the housing 2 (see FIG. 2) including the rotational axis L.

In the cross-section of the housing 2 including the rotational axis L, as the inclination angle α between the tangential direction A of a radially outer edge 24*a*1 of the concave arc portion 24*a* and the direction B perpendicular to the rotational axis L decreases, the angle β between the swirl flow $f_2$ and the flow $f_3$ of the compressed air that is about to flow from the diffuser passage 8 to the scroll passage 5 decreases. Thus, since interference between the swirl flow $f_2$ and the flow $f_3$ of the compressed fluid is reduced, the occurrence of separation is reduced. Accordingly, by making the cross-sectional shape of the scroll passage 5 such that the inclination angle α is small at the portion where interference can occur, it is possible to reduce the occurrence of separation.

Further, the present inventors have found that separation is likely to occur in a range of the central angle θ of 30° to 210° by CFD analysis. The reason is that when stable swirl flow is generated in the scroll passage 5, the swirl flow in the scroll passage 5 and the flow of the compressed air discharged from the diffuser passage 8 gradually stop interfering with each other, and thus interference is mainly caused on the upstream side in the scroll passage 5. Accordingly, by making the cross-sectional shape of the scroll passage 5 such that the inclination angle α is small on the upstream side, it is possible to effectively reduce the occurrence of separation.

Figure 6:
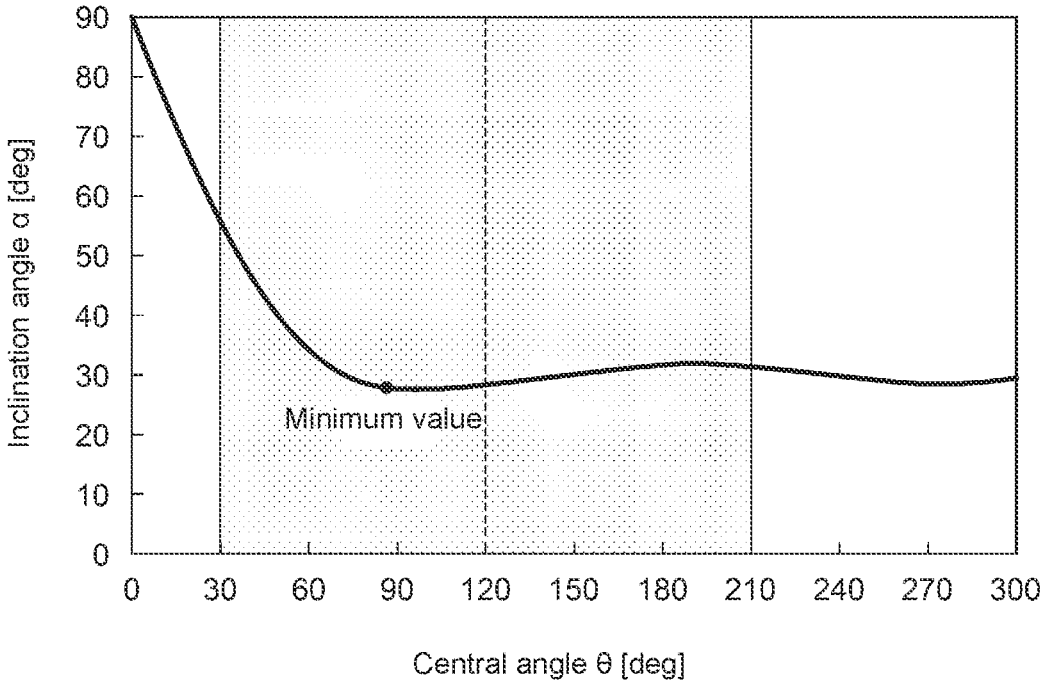
FIG. 6 is a graph representing the distribution of inclination angle $\alpha$ in a centrifugal compressor according to an embodiment of the present disclosure.

The cross-sectional shape of the scroll passage 5 shown in FIG. 5 is the shape of one cross-section of the housing 2 (see FIG. 2). Actually, the cross-sectional shape of the scroll passage 5 changes along the circumferential direction. Accordingly, the inclination angle α changes along the circumferential direction. That is, the inclination angle α is distributed along the circumferential direction of the scroll passage 5. According to the findings by the present invention, as shown in FIG. 6, when the distribution of the inclination angle α has a minimum value in a range of the circumferential position of the scroll passage 5 where the central angle θ is 30° to 210°, it is possible to effectively reduce the occurrence of separation. The distribution of the inclination angle α may not have the minimum value in the above range, but may have a local minimum value in the range of the central angle θ of 30° to 210°. In other words, in a range of the central angle θ larger than 210°, the distribution of the inclination angle α may have a value smaller than the local minimum value.

Next, some embodiments of the housing 2 (see FIG. 2) in which the distribution of the inclination angle α has a minimum value or a local minimum value in the range of the central angle θ of 30° to 210° will be described.

In an embodiment, the outer diameter of the diffuser passage 8 (see FIG. 1) is increased locally in the circumferential direction. More specifically, the distribution of the outer diameter of the diffuser passage 8 in the circumferential direction has a local maximum value or a maximum value in the range of the central angle θ of 30° to 210°.

Referring to FIG. 5, the end surface 22 of the second passage wall 7*b* is located on a more radially outer side at a portion where the outer diameter of the diffuser passage 8 is locally increased than at other portions. Thus, since the width of the concave inner wall surface 24 in the radial direction is increased, the inclination of the tangential direction A of the portion Sal becomes closer to the horizontal direction, and the inclination angle α is decreased.

Figure 7:
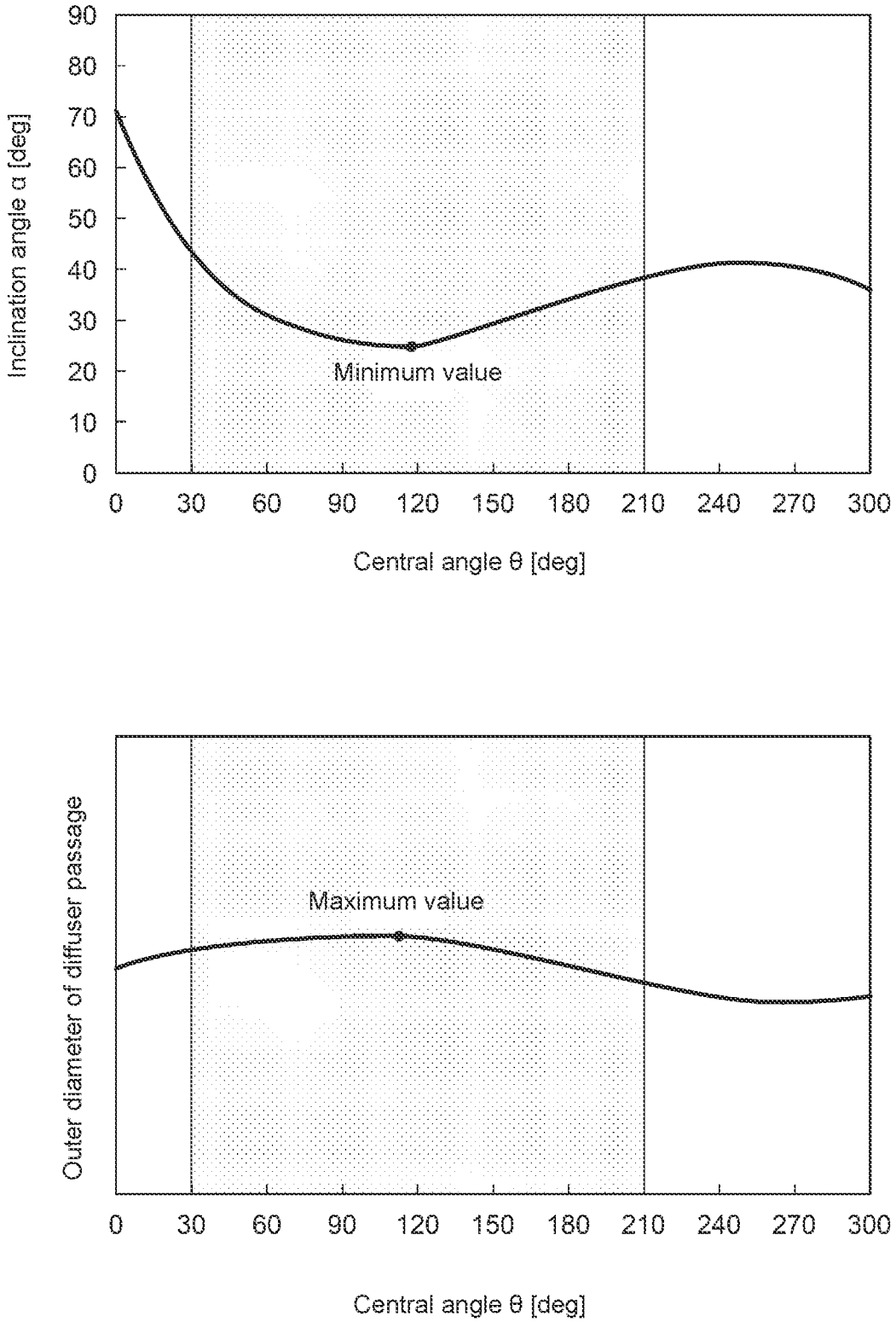
FIG. 7 is graphs representing the distribution of the outer diameter of a diffuser passage and the distribution of inclination angle $\alpha$ in a centrifugal compressor according to an embodiment of the present disclosure.

FIG. 7 shows a graph representing the distribution of the outer diameter of the diffuser passage 8 in the circumferential direction and a graph representing the distribution of the inclination angle α in this case. When it is configured such that the outer diameter of the diffuser passage 8 has a maximum value in the range of the central angle θ of 30° to 210°, the inclination angle α has a minimum value in the range of the central angle θ of 30° to 210°. In a case where the inclination angle α does not have a minimum value but has a local minimum value in this range, it is configured such that the outer diameter of the diffuser passage 8 has a local maximum value in the range of the central angle θ of 30° to 210°.

Alternatively, in some embodiments, a distance R (see FIG. 2) from the rotational axis L to the scroll center $O_s$ of the scroll passage 5 is decreased locally in the circumferential direction. More specifically, the distribution of the distance R in the circumferential direction has a local minimum value or a minimum value in the range of the central angle θ of 30° to 210°. Referring to FIG. 5, the cross-section of the scroll passage 5 is located on a more radially inner side at a portion where the distance R is locally decreased than at other portions, although the outlet of the diffuser passage 8 is at the same position. Thus, since the inclination of the tangential direction A of the portion 5*a*1 becomes closer to the horizontal direction, the inclination angle α is decreased.

Figure 8:
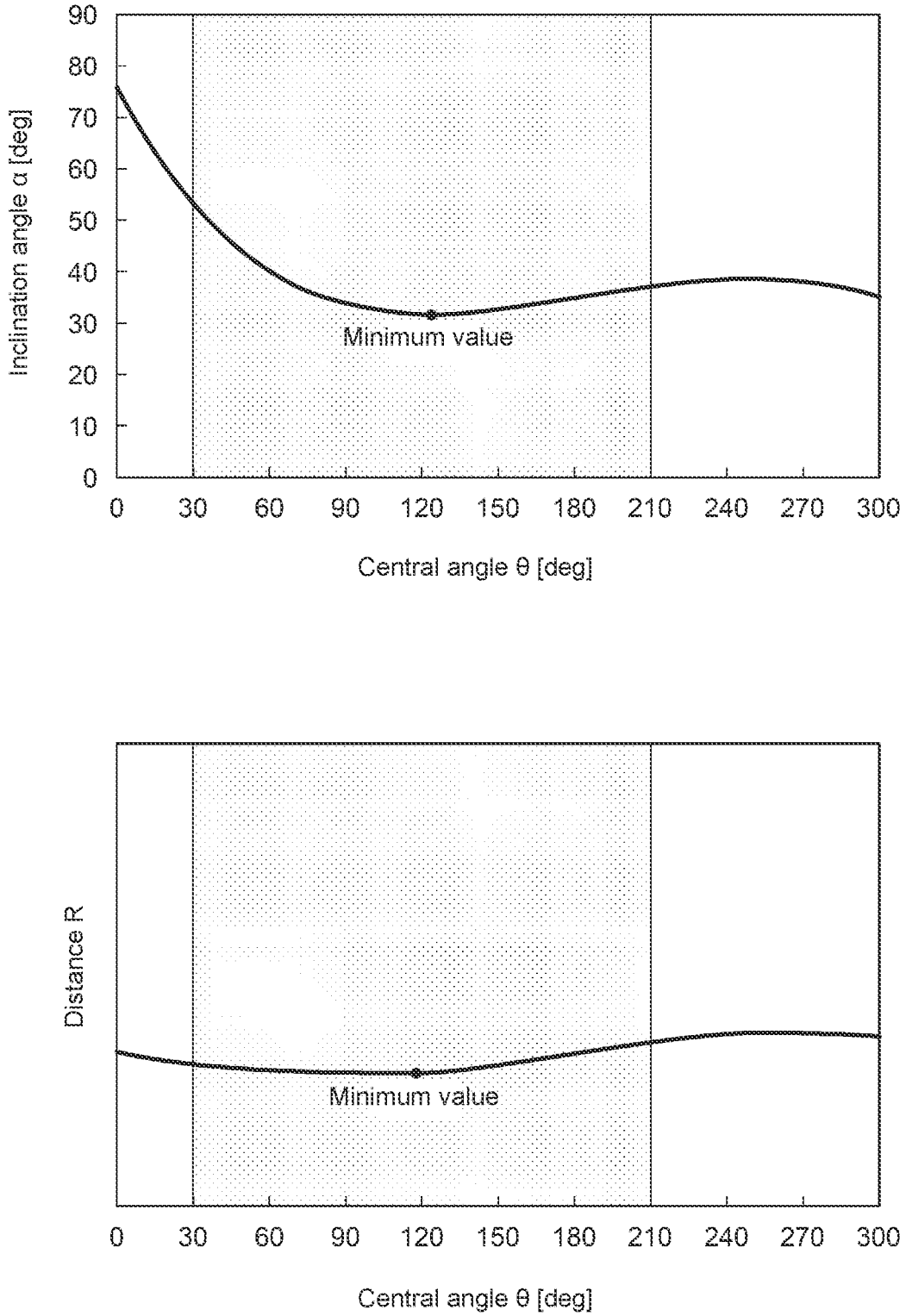
FIG. 8 is graphs representing the distribution of the distance between the rotational axis and the scroll center and the distribution of inclination angle $\alpha$ in a centrifugal compressor according to an embodiment of the present disclosure.

FIG. 8 shows a graph representing the distribution of the distance R in the circumferential direction and a graph representing the distribution of inclination angle α in this case. When it is configured such that the distance R has a minimum value in the range of the central angle θ of 30° to 210°, the inclination angle α has a minimum value in the range of the central angle θ of 30° to 210°. In a case where the inclination angle α does not have a minimum value but has a local minimum value in this range, it is configured such that the distance R has a local minimum value in the range of the central angle θ of 30° to 210°.

Alternatively, in some embodiments, locally increasing the outer diameter of the diffuser passage 8 (see FIG. 1) in the circumferential direction is combined with locally decreasing the distance R (see FIG. 2) from the rotational axis L to the scroll center $O_s$ of the scroll passage 5 in the circumferential direction. If one of these measures is adopted alone, the outer diameter of the diffuser passage 8 may be excessively locally increased, or the distance R may be excessively locally decreased. In this case, manufacturing may be difficult, or the flow f the compressed air may be adversely affected. However, by combining them, it is possible to moderate the local changes in the outer diameter of the diffuser passage 8 and the distance R.

As described above, as the swirl flow $f_2$ swirling and flowing through the scroll passage 5 along the inner wall surface 5*a* of the scroll passage 5 circulates one round along the inner wall surface 5*a* of the scroll passage 5, the angle β between the direction of the swirl flow $f_2$ and the direction of the flow $f_3$ of the compressed fluid discharged from the diffuser passage 8 decreases. Thus, interference between the swirl flow $f_2$ and the flow $f_3$ of the compressed fluid discharged from the diffuser passage 8 is reduced, and the occurrence of separation in the scroll passage 5 is reduced. As a result, it is possible to improve the efficiency of the centrifugal compressor 1 in a low flow rate operating point.

In the above embodiments, the second passage wall 7*b* includes the flat end surface 22 connected to the flat inner wall surface 21 at right angle, the convex inner wall surface 23 connected to the end surface 22 and curved convexly with respect to the scroll passage 5, and the concave inner wall surface 24 connected to the convex inner wall surface 23 and curved concavely with respect to the scroll passage 5. However, the present invention is not limited thereto. The end surface 22 may not be perpendicular to the flat inner wall surface 21. The end surface 22 may be not flat but curved. Further, the convex inner wall surface 23 may be eliminated, and the concave inner wall surface 24 and the end surface may be connected to each other.

Figure 9:
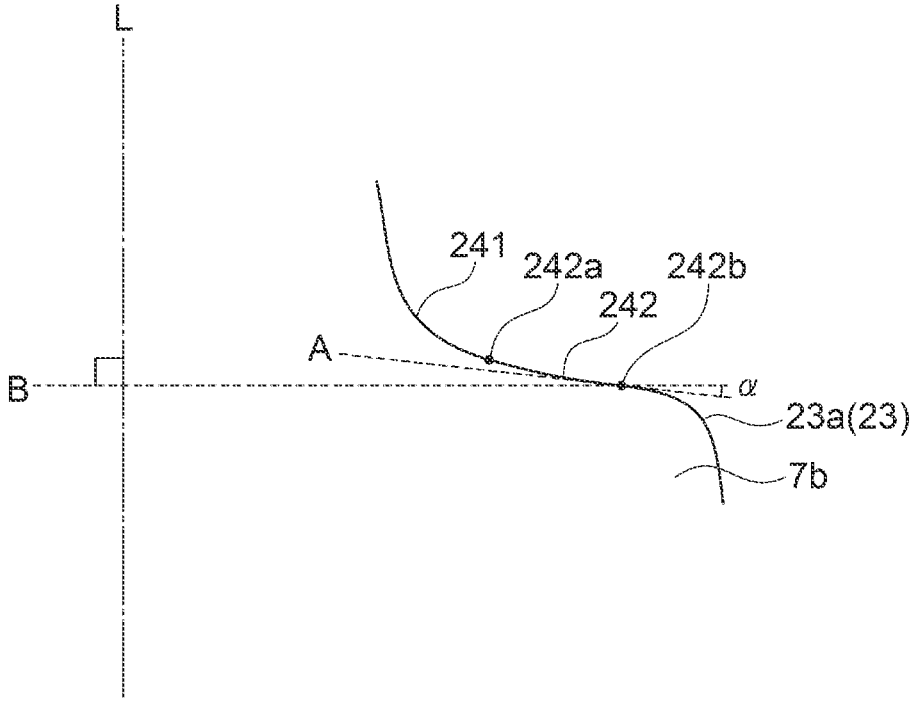
FIG. 9 is an enlarged partial cross-sectional view of a second passage wall of a centrifugal compressor according to an embodiment of the present disclosure.

Further, two or more concave inner wall surfaces 24 may be included. FIG. 9 shows an example in which the concave inner wall surface 24 includes two concave inner wall surfaces. In the cross-section of the housing 2 (see FIG. 2) including the rotational axis L, the two concave inner wall surfaces may form a first concave arc portion 241 and a second concave arc portion 242, respectively. The second concave arc portion 242 has a radially inner edge 242*a* and a radially outer edge 242*b*, and the edge 242*a* is connected to the first concave arc portion 241, and the edge 242*b* is connected to the convex arc portion 23*a*. In this embodiment, the inclination angle α is an angle between the tangential direction A of the radially outer edge of the radially outermost concave arc portion, i.e. the tangential direction A of the radially outer edge 242*b* of the second concave arc portion 242, and the direction β perpendicular to the rotational axis L.

Although in the above embodiments, the distribution of the inclination angle α has a local minimum value or a minimum value in the range of the central angle θ of 30° to 210°, it may have a local minimum value or a minimum value in the range of the central angle θ of 30° to 120° (see FIG. 6). As shown in FIG. 1, the flow passage area of the scroll passage 5 gradually decreases from the outlet toward the tongue 4*a*. Due to this shape of the scroll passage 5, the inclination angle α (see FIG. 5) of the concave arc portion 24*a* (see FIG. 5) tends to increase as it approximates to the tongue 4*a*. If the scroll passage 5 is formed without considering the size of the inclination angle α, the inclination angle α tends to increase in the range of the central angle θ of 30° to 120°. However, by forming the scroll passage 5 such that the inclination angle α has a local minimum value or a minimum value in the range of the central angle θ of 30° to 120°, the inclination angle α is decreased in this range. Thus, interference between the swirl flow $f_2$ and the flow $f_3$ of the compressed fluid discharged from the diffuser passage 8 is reduced, and the occurrence of separation in the scroll passage 5 is reduced. As a result, it is possible to improve the efficiency of the centrifugal compressor 1 in a low flow rate operating point.

Further, although the diffuser passage is generally formed by cutting, in the above embodiments, since the flat inner wall surface 21 defining the diffuser passage 8 is flat and perpendicular to the rotational axis L, it is easy to process the diffuser passage 8.

REFERENCE SIGNS LIST

1 Centrifugal compressor
2 Housing

3 Impeller
4 Scroll part
4*a* Tongue
5 Scroll passage
5*a* Inner wall surface (of scroll passage)
5*a*1 Portion (of inner wall surface)
5*a*2 Radially inner portion (of inner wall surface)
5*a*3 Radially outer portion (of inner wall surface)
6 Diffuser part
7 Passage wall
7*a* First passage wall
7*b* Second passage wall
8 Diffuser passage
9 Air inlet part
21 Flat inner wall surface
22 End surface
23 Convex inner wall surface
23*a* Convex arc portion
24 Concave inner wall surface
24*a* Concave arc portion
24*a*1 Edge (of concave arc portion)
241 First concave arc portion
242 Second concave arc portion
242*a* Edge (of second concave arc portion)
242*b* Edge (of second concave arc portion)
A Tangential direction
B Direction perpendicular to rotational axis
L Rotational axis (of impeller)
L' Virtual line
$O_s$ Scroll center
α Inclination angle
β Angle
θ Central angle
$f_1$ Flow of compressed air discharged from diffuser passage in vicinity of tongue
$f_2$ Swirl flow
$f_3$ Flow of compressed air discharged from diffuser passage

The invention claimed is:

1. A centrifugal compressor comprising an impeller and a housing, wherein the housing includes:

a scroll part having a scroll passage of a spiral shape formed on an outer peripheral side of the impeller; and a diffuser part including a pair of passage walls spaced from each other in an extension direction of a rotational axis of the impeller, the diffuser part forming a diffuser passage between the pair of passage walls, the diffuser passage communicating with the scroll passage along a circumferential direction of the scroll passage on a radially inner side of the impeller, wherein the pair of passage walls includes:

a first passage wall; and a second passage wall positioned closer to a scroll center of the scroll passage than the first passage wall is to the scroll center in the extension direction of the rotational axis, wherein the second passage wall includes a radially inner portion of an inner wall surface of the scroll passage, and the radially inner portion of the inner wall surface included in the second passage wall forms at least one concave arc portion having a curvature center inside the scroll passage in a cross-section of the housing formed by a plane that includes the rotational axis, wherein the at least one concave arc portion includes a radially outermost concave arc portion located outermost in a radial direction of the impeller, and an inclination angle between a tangential direction of a radially outer edge of the radially outermost concave arc portion and a direction perpendicular to the rotational axis has a distribution along the circumferential direction of the scroll passage, and wherein, when a circumferential position in the scroll passage from a tongue of the scroll part to an outlet of the scroll passage is represented by a central angle about the rotational axis by using the tongue as a reference, the distribution of the inclination angle has a local minimum value or a minimum value in a range of the central angle of 30° to 120°.

2. The centrifugal compressor according to claim 1, wherein the second passage wall includes:

a flat inner wall surface which defines the diffuser passage and is flat and perpendicular to the rotational axis;

a convex inner wall surface defining the scroll passage and curved convexly with respect to the scroll passage;

at least one concave inner wall surface defining the scroll passage and forming the at least one concave arc portion in the cross-section of the housing formed by the plane that includes the rotational axis, the at least one concave inner wall surface including a radially outermost concave inner wall surface located outermost in the radial direction of the impeller, the radially outermost concave inner wall surface being connected to the convex inner wall surface; and an end surface connecting the flat inner surface and the convex inner wall surface at an outermost portion of the flat inner surface in the radial direction of the impeller.

3. The centrifugal compressor according to claim 1, wherein an outer diameter of the diffuser passage about the rotational axis has a distribution in a circumferential direction of the diffuser passage, and the distribution of the outer diameter of the diffuser passage has a local maximum value or a maximum value in a range of the central angle of 30° to 210°.

4. The centrifugal compressor according to claim 1, wherein a distance from the rotational axis to the scroll center of the scroll passage has a distribution in a circumferential direction of the diffuser passage, and the distribution of the distance has a local minimum value or a minimum value in a range of the central angle of 30° to 210°.

5. A turbocharger comprising the centrifugal compressor according to claim 1.

* * * * *